US007905329B2

(12) United States Patent
Urata

(10) Patent No.: US 7,905,329 B2
(45) Date of Patent: Mar. 15, 2011

(54) EARTHQUAKE CONTROL OPERATING SYSTEM FOR AN ELEVATOR AND EARTHQUAKE CONTROL OPERATING METHOD FOR AN ELEVATOR

(75) Inventor: Masazumi Urata, Chiba (JP)

(73) Assignee: Otis Elevator Company, Farmington, CT (US)

( * ) Notice: Subject to any disclaimer, the term of this patent is extended or adjusted under 35 U.S.C. 154(b) by 537 days.

(21) Appl. No.: 12/095,520

(22) PCT Filed: Dec. 5, 2006

(86) PCT No.: PCT/US2006/046264

§ 371 (c)(1),
(2), (4) Date: May 30, 2008

(87) PCT Pub. No.: WO2007/067491

PCT Pub. Date: Jun. 14, 2007

(65) Prior Publication Data

US 2010/0213013 A1 Aug. 26, 2010

(30) Foreign Application Priority Data

Dec. 5, 2005 (JP) ..... 2005-350145

(51) Int. Cl.
*B66B 1/20* (2006.01)

(52) U.S. Cl. ..... 187/384; 187/278

(58) Field of Classification Search ..... 187/247, 187/278, 313, 391–394, 380–388
See application file for complete search history.

(56) References Cited

U.S. PATENT DOCUMENTS

| | | | | |
|---|---|---|---|---|
| 4,382,489 | A * | 5/1983 | Suzuki et al. | 187/278 |
| 4,809,817 | A * | 3/1989 | Kawai | 187/278 |
| 4,998,601 | A * | 3/1991 | Suzuki | 187/278 |
| 5,910,761 | A * | 6/1999 | Kobayashi et al. | 338/21 |
| 7,182,174 | B2 * | 2/2007 | Parrini et al. | 182/18 |
| 7,588,126 | B2 * | 9/2009 | Siikonen et al. | 187/384 |
| 7,594,564 | B2 * | 9/2009 | Siikonen et al. | 187/384 |
| 7,681,696 | B2 * | 3/2010 | Yamagishi | 187/384 |
| 7,784,590 | B2 * | 8/2010 | Watanabe et al. | 187/393 |
| 7,789,204 | B2 * | 9/2010 | Amano | 187/393 |
| 2008/0196978 | A1 * | 8/2008 | Siikonen et al. | 187/384 |
| 2009/0133963 | A1 * | 5/2009 | Amano | 187/247 |

FOREIGN PATENT DOCUMENTS

| | | |
|---|---|---|
| EP | 1433735 A1 | 6/2004 |
| JP | 2123083 | 5/1990 |
| JP | 2000335844 | 12/2000 |
| JP | 2003146552 | 5/2003 |

* cited by examiner

*Primary Examiner* — Jonathan Salata
(74) *Attorney, Agent, or Firm* — Carlson, Gaskey & Olds PC

(57) ABSTRACT

An earthquake control operating system for an elevator is provided so that the elevator can operate free of the influence of earthquakes. Data concerning zones without resonance between the intrinsic vibration frequency of the ropes of the elevator and the intrinsic vibration frequency of the building, and data corresponding to the speed at which vibrations of ropes of the elevator are in a safe range during a long-period seismic wave are stored in a database. When an emergency earthquake report is received by an emergency earthquake information receiver, the elevator car is driven to a floor free of resonance at the speed stored in database. Then, when it is judged that the long-period seismic wave has been sufficiently attenuated on the basis of a detection signal of a long-period vibration sensor, the operation of the elevator is restored.

16 Claims, 13 Drawing Sheets

FIG.11A
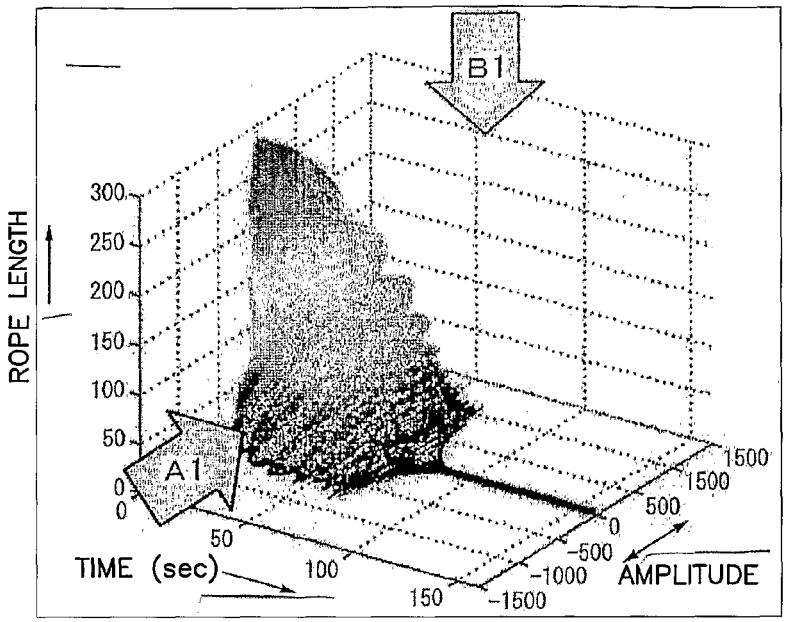
FIG.11B
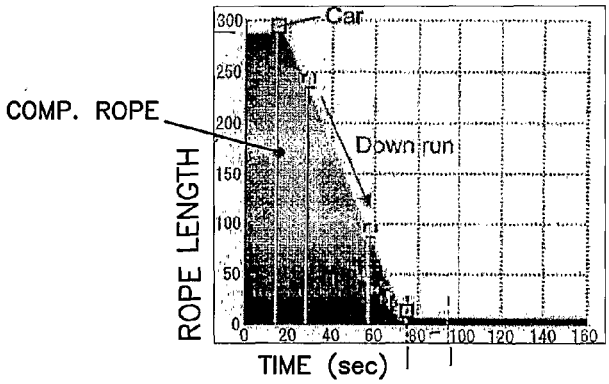
FIG.11D
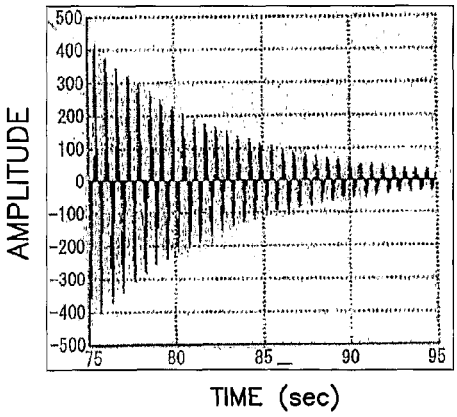
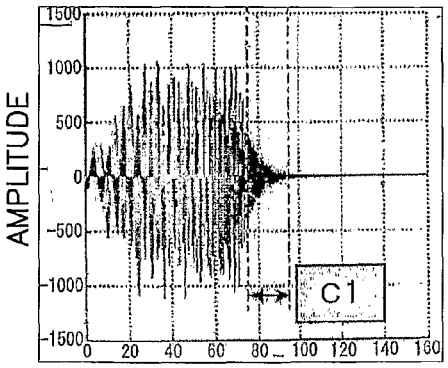
FIG.11C

EARTHQUAKE CONTROL OPERATING SYSTEM FOR AN ELEVATOR AND EARTHQUAKE CONTROL OPERATING METHOD FOR AN ELEVATOR

BACKGROUND

The present invention relates to an earthquake control operating system for an elevator during earthquakes, especially, long-period earthquakes.

A long-period earthquake refers to an earthquake that can hardly be felt by humans. The shaking associated with a long-term earthquake are slow, with a period of several seconds to ten seconds. The longer the period, the more an earthquake is damped such that it can be transmitted several hundred kilometers. A long-period earthquake predominately takes place during major earthquakes. The long-term earthquake is maintained in the soft earth layers and it is amplified in flat regions, thereby enabling it to last for a long time. As a result, tall buildings are apt to resonate with the long-period vibration. The resonance causes building vibrations to increase, thereby possibly causing damage. For example, in the Tokachigawa Earthquake in 2003, a vibration of liquid surfaces in oil tanks occurred, thereby causing two fires.

As described in Japanese Patent Application Nos. 2004-224469 and 2004-284758, an earthquake control operating system for an elevator has been proposed that stops or controls the operation of the elevator before the arrival of the earthquake in the region concerned. However, in the earthquake control operating system for an elevator in the prior art, including the systems described in Japanese Patent Application Nos. 2004-224469 and 2004-284758, there is the following problem: in many cases, it is impossible to detect the vibration of a long-period earthquake. In this case, lateral vibration of a building (building sway) takes place due to the long-period earthquake. As the vibration frequency may be in agreement with the intrinsic vibration frequency of the ropes of elevators (resonance), the elevator equipment may become damaged. In addition, as it may be impossible to detect the long-period earthquake, accidental enclosure of passengers in elevator cars may occur.

Even when a long-period earthquake is detected with an earthquake detector or the like and earthquake control operation is performed, when the vibration becomes lower than the detection level of the earthquake detector, the elevator may automatically (and prematurely) resume operation. As a result, in the case of an enduring long-period seismic wave, secondary hazards may occur.

In addition, even when an earthquake control operation is performed after detection of a long-period earthquake, the earthquake control operation necessarily is executed some time after the detection. The delay between detection and control may be such that the control occurs after earthquake has arrived, i.e., the control may fail to be timely actuated.

In light of the foregoing, the present invention aims to resolve one or more of the aforementioned issues that afflict conventional earthquake control operating systems. More specifically, the present invention aims to solve the aforementioned problems of the prior art by providing an earthquake control operating system for an elevator and an earthquake control operating method for an elevator in which it is possible to ensure passenger safety and to prevent damage to the elevator equipment.

SUMMARY

An embodiment of the present invention addresses an earthquake control operating system for an elevator car provided in a hoistway of a building. This system includes, among other possible things, a receiver, a database, and a controller. The receiver is configured to receive emergency earthquake information. The database stores data pertaining to movement of the elevator car in the hoistway to a zone that is substantially unaffected by the influence of long-period vibrations. The controller is interfaced with the receiver and the database. Further, the controller is configured to move the elevator car to a zone that is substantially unaffected by the influence of the long-period vibrations on the basis of the data stored in the database when the emergency earthquake information is received by the receiver.

In a further embodiment of this system, the controller may be configured to determine whether there are any passengers in the elevator car when the emergency earthquake information is received by the receiver. In a further embodiment, the controller may also further be configured to move the car to a nearest floor at which the doors of the elevator can be opened, if it is determined that any passengers are in the elevator car.

In another further embodiment of this system, the system may further include a long-period vibration detector provided in the building in which the elevator car is provided. In a further embodiment, the controller may be configured to resume the operation of the elevator car after a predetermined attenuation of the long-period vibration on the basis of signals from the long-period vibration detector.

In another further embodiment of this system, the database may store data of the intrinsic vibration frequency of one or more ropes of the elevator and one or more zones in which there is no resonance of the one or more ropes with the intrinsic vibration frequency of the building. In a further embodiment, the controller may be configured to move the elevator car to one of the zones free of resonance.

In another further embodiment of this system, the database may store data of a speed at which the one or more ropes of the elevator have their intrinsic vibration frequency in a safety range in the case of long-period vibrations. In a further embodiment, the controller may be configured to move the elevator car at this speed.

Another embodiment of the present invention addresses an earthquake control operating method for an elevator operating in a building. This method includes, among other possible steps: determining one or more zones in the building that are substantially unaffected by the influence of long-period vibrations; storing the zones that are substantially unaffected by the influence of long-period vibrations in database; receiving emergency earthquake information; obtaining, from the database, the one or more zones that are substantially unaffected by the influence of long-period vibrations; and moving a car of the elevator to one of the one or more zones that are substantially unaffected by the influence of long-period vibrations.

In a further embodiment of this method, the method may additionally include the step of determining whether one or more passengers are in the car, when the emergency earthquake information is received. In a further embodiment, if it is determined that one or more passengers are in the car when the emergency earthquake information is received, the method additionally include the step of: moving the car to a nearest floor; and opening doors of the car so as to enable the one or more passengers to exit the car.

In another further embodiment of this method, the method may additionally include the step of maintaining the car in a non-operative state in the zone that is substantially unaffected by the influence of long-period vibrations until it is determined that the long-term period vibrations are attenuated to a predetermined degree. In a further embodiment, the method may additionally include the step of enabling the car to return to an operative state, when it determined that the long-term period vibrations are attenuated to the predetermined degree.

In another further embodiment of this method, the step of determining one or more zones in the building that are substantially unaffected by the influence of long-period vibrations may include the step of: ascertaining an intrinsic vibration frequency of one or more ropes that are connected to the car; ascertaining an intrinsic vibration frequency of the building; and identifying one or more zones in the building in which the intrinsic vibration of the one or more ropes and the intrinsic vibration of the building are not in resonance. In a further embodiment, the one or more zones in which the intrinsic vibration frequency of the one or more ropes and the intrinsic vibration frequency of the building are not in resonance may define the one or more zones in the building that are substantially unaffected by the influence of long-period vibrations.

In another further embodiment of this method, the step of determining one or more zones in the building that are substantially unaffected by the influence of long-period vibrations may further include the step of ascertaining a safety speed at which the one or more ropes that are connected to the car can move to create a vibration frequency that is within a range that does not resonantly interact with the intrinsic vibration frequency of the building. In a further embodiment, the step of moving the car of the elevator to one of the one or more zones that are substantially unaffected by the influence of long-period vibrations may include the step of moving the car at the safety speed to one of the one or more zones that are substantially unaffected by the influence of long-period vibrations.

As a result of the foregoing, when emergency earthquake information is received, the elevator car may be moved to a zone that is substantially unaffected by the influence of the long-period vibrations. Consequently, before the arrival of the earthquake, it is possible for the elevator car to stand by in the zone such that it is possible to prevent (or at least minimize the likelihood of) damage to the elevator equipment. Further, when the emergency earthquake information is received, the car may be moved to the nearest floor at which the doors of the elevator can be opened, thereby enabling passengers to seek safety before the arrival of the earthquake.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

FIGS. 7A-7C are diagrams illustrating the resultant characteristics of a behavioral prediction of a compensation rope when an elevator car stops on a dangerous floor in which FIG. 7A is a three-dimensional graphical depiction of the rope length versus time versus amplitude; FIG. 7B is a two-dimensional graphical depiction of the time and amplitude; and FIG. 7C is a two-dimensional graphical depiction of the rope length and amplitude;

FIGS. 8A-8C are diagrams illustrating the resultant characteristics of a behavioral prediction of a main rope when an elevator car stops on a dangerous floor in which FIG. 8A is a three-dimensional graphical depiction of the rope length versus time versus amplitude; FIG. 8B is a two-dimensional graphical depiction of the time and amplitude; and FIG. 8C is a two-dimensional graphical depiction of the rope length and amplitude;

FIGS. 9A-9C are diagrams illustrating the resultant characteristics of a behavioral prediction of the compensation rope when an elevator car stops on a safe floor in which FIG. 9A is a three-dimensional graphical depiction of the rope length versus time versus amplitude; FIG. 9B is a two-dimensional graphical depiction of the time and amplitude; and FIG. 9C is a two-dimensional graphical depiction of the rope length and amplitude;

FIGS. 10A-10C are diagrams illustrating the resultant characteristics of a behavioral prediction of the main rope when an elevator car stops on a safe floor in which FIG. 10A is a three-dimensional graphical depiction of the rope length versus time versus amplitude; FIG. 10B is a two-dimensional graphical depiction of the time and amplitude; and FIG. 10C is a two-dimensional graphical depiction of the rope length and amplitude;

FIGS. 11A-11D are diagrams illustrating the resultant characteristics of a behavioral prediction of the compensation rope when the elevator car moves from an upper dangerous floor to the bottom floor at a speed of 5 msec in which FIG. 11A is a three-dimensional graphical depiction of the rope length versus time versus amplitude; FIG. 11B is a two-dimensional graphical depiction of the rope length and time; FIG. 11C is a two-dimensional graphical depiction of the amplitude and time; and FIG. 11D is an enlarged portion of the graphical depiction shown in FIG. 11C;

FIGS. 12A-12D are diagrams illustrating the resultant characteristics of a behavioral prediction of the compensation rope when the elevator car moves from an upper dangerous floor to the bottom floor at a speed of 2.5 m/sec in which FIG. 12A is a three-dimensional graphical depiction of the rope length versus time versus amplitude; FIG. 12B is a two-dimensional graphical depiction of the rope length and time; FIG. 12C is a two-dimensional graphical depiction of the amplitude and time; and FIG. 12D is an enlarged portion of the graphical depiction shown in FIG. 12C;

FIGS. 13A-13B illustrate an embodiment of a pendulum sensor of the present invention in which FIG. 13A is a front view of the pendulum and FIG. 13B is an oblique view of the pendulum;

DETAILED DESCRIPTION

Figure 1:
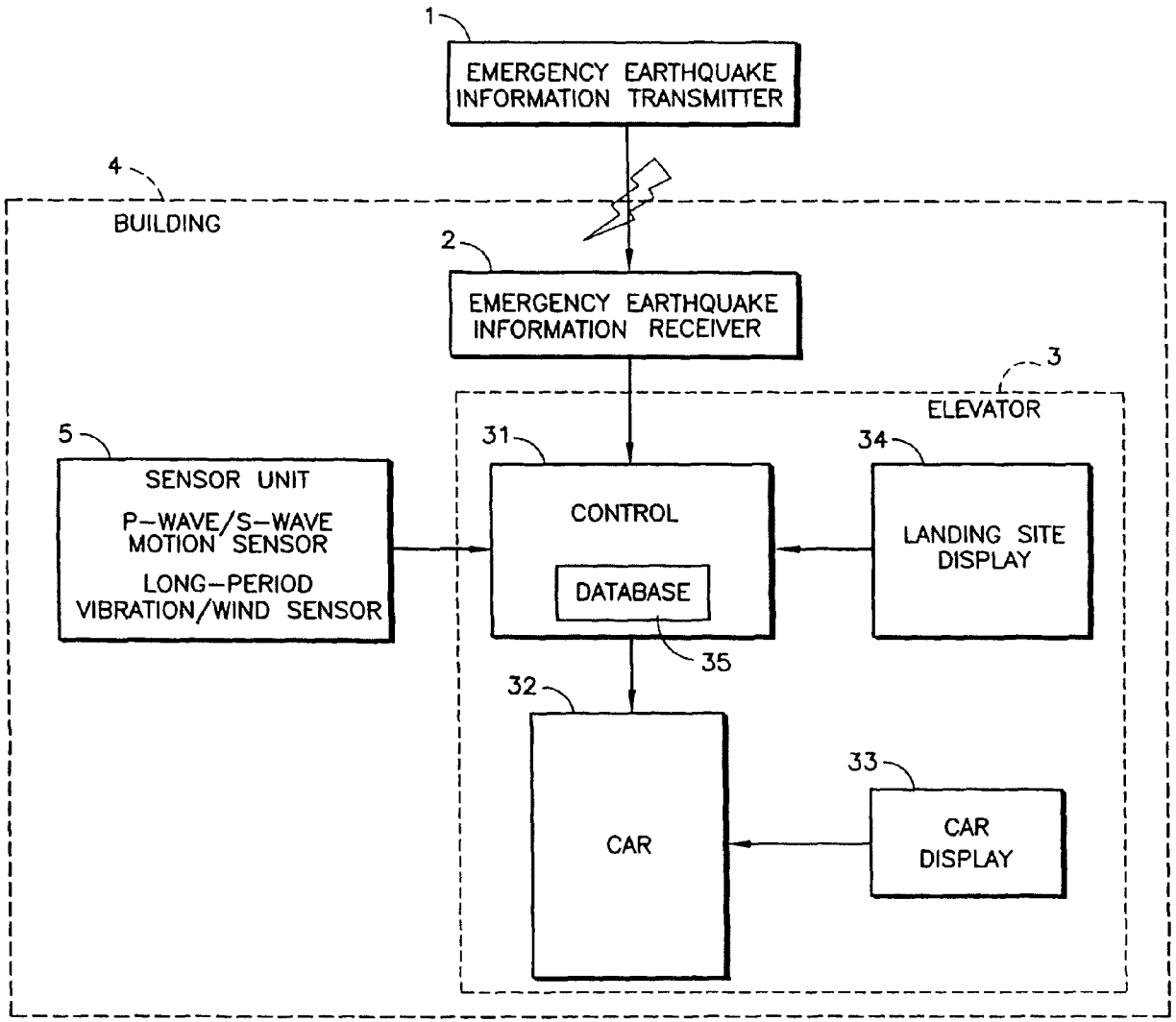
FIG. 1 is a schematic diagram illustrating an embodiment of the present invention.

The present invention will be explained in more detail with reference to exemplary embodiments illustrated in the Figures. The present invention, however, is not limited to the following embodiments. Efforts have been made throughout the drawings to use the same or similar reference numerals for the same or like components.

FIG. 1 is a diagram illustrating an embodiment of an earthquake control operating system for an elevator. As shown in FIG. 1, an emergency earthquake information transmitter 1 transmits emergency earthquake reports (e.g., Now Cast earthquake information of the Agency of Weather, Hi-net) and real-time earthquake information of the Real-Time Earthquake Information Application Council. An emergency earthquake information receiver 2 for receiving the emergency earthquake information (receiving means) is provided in a building 4 in which an elevator 3 operates. A controller 31 (control means) for the elevator 3 receives signals from the emergency earthquake information receiver 2 and from a sensor unit 5. The sensor unit 5 receives signals from various sensors (e.g., a P-wave sensor, an S-wave sensor, a wave motion sensor, a long-period vibration detecting means, a pendulum type sensor, a wind sensor, etc.) throughout the building 4. The controller 31 uses the signals from the sensor unit 5 and the emergency earthquake information receiver 2 as inputs to control the operation of a car 32 and both a car display 33 and a landing site display 34. A database 35 is set in the controller 31 to store the various data pertaining to the movement of elevator car 32 to a zone that is substantially unaffected by the influence of the long-period vibrations.

When the emergency earthquake information receiver 2 receives emergency earthquake information, the controller 31 performs as follows: on the basis of the data in the database 35, the elevator car 32 is moved to and stopped in a zone that is substantially unaffected by the influence of the long-period vibrations. The operation of elevator car 32 is restored when it is detected, on the basis of a detection signal of the sensor unit 5, that the long-period vibrations have sufficiently attenuated. In addition, the controller 31 determines whether there are passengers in the elevator car when the emergency earthquake information is received, and, if so, the controller 31 moves the car 32 to the nearest floor at which the doors of the elevator can be opened. The controller 21 also performs various controls for normal operation. The various controls performed by the controller 31 are performed by means of a computer in the controller 31 and peripheral equipment.

Figure 2:
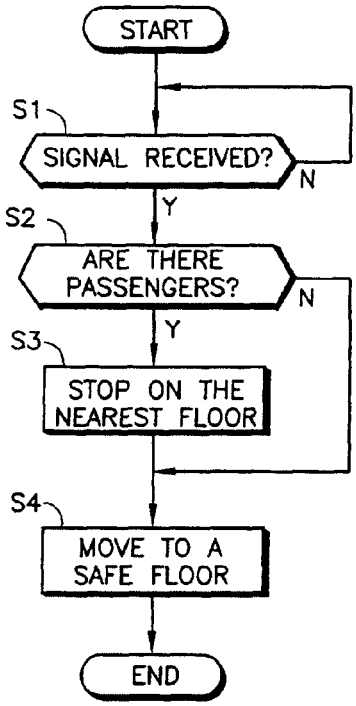
FIG. 2 is a flow chart illustrating an embodiment of a control process used in case of an earthquake.

An explanation will be given regarding the process flow performed by controller 31, as shown in FIG. 2, when an earthquake occurs. First, as an earthquake occurs in a region at a prescribed distance from the building 4, an emergency earthquake report is transmitted by the emergency earthquake information transmitter 1. Accordingly, in step S1, it is determined whether an emergency earthquake information signal has been received. If the result of step S1 is negative, control reverts back to the start. If, however, the result of step S1 is positive, control flows to step S2 at which it is determined whether there are passengers in the car 32 (e.g., on the basis of a signal from a load cell or another sensor). If the result of step S2 is negative, control flows to step S4, which will later be discussed. If, however, the result of step S2 is positive, control flows to step S3. In step S3, the elevator car 32 is moved to the nearest floor at which the doors of the elevator can be opened and then the doors are opened to let the passengers out. Subsequently, in step S4, the elevator car 32 is moved to a zone that is substantially unaffected by the influence of the long-period seismic wave; such a zone is ascertained from the database 35. Then, the operation pauses and the process ends.

In this embodiment, at the time the emergency earthquake report signal is received, if there are passengers in the car, the car is moved to the nearest floor at which the doors of the elevator can be opened (and the doors are then opened). On the other hand, if there are no passengers, the control is performed so that the elevator car is immediately moved to a zone that is substantially unaffected by the influence of the long-period seismic waves before the arrival of the earthquake to the building 4. As a result, the passengers can seek safety before the long-period vibrations arrive and the likelihood of damage to the elevator can be reduced.

Figure 3:
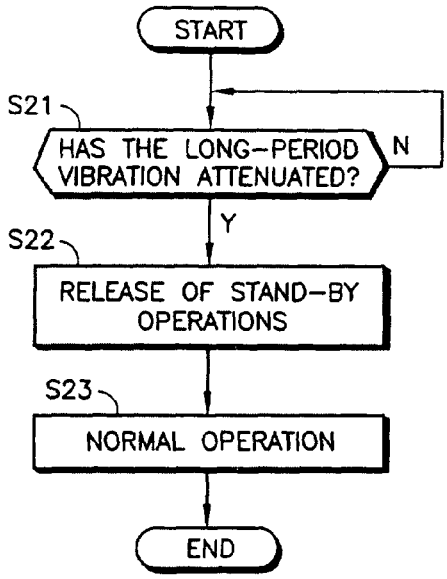
FIG. 3 is a flow chart illustrating an embodiment of a control process used to restore elevator operation after an earthquake has stopped.

FIG. 3 is a schematic diagram illustrating the process performed by controller 31 to restore elevator service when the long-period seismic wave is sufficiently attenuated. First, in step S21, on the basis of the detection signal of the long-period vibration sensor of the sensor unit 5, it is determined whether the long-period seismic wave has attenuated. If the result of step S21 is negative, control reverts to step S21. If, however, the result of step S21 is positive, control proceeds to step S22. In step S22, the standby operation of the elevator 3 is released and a check of the safety and test operations, etc. is performed. Then, in step S23, normal operation is restored, and the process ends.

In this way, the restoration of the elevator operation is performed on the basis of the signal detected by the long-period vibration sensor. Consequently, it is possible to determine the attenuation of the long-period seismic wave, which used to be difficult to detect reliably with a conventional earthquake sensor, and it is possible to quickly restore the operation of the elevator.

The data stored in the database 35 that pertains to the movement of the elevator car to a zone that is substantially unaffected by the influence of the long-period seismic wave is determined by means of simulation analysis. In the following, an explanation will be given with respect to various specific examples of such analysis.

Figure 4:
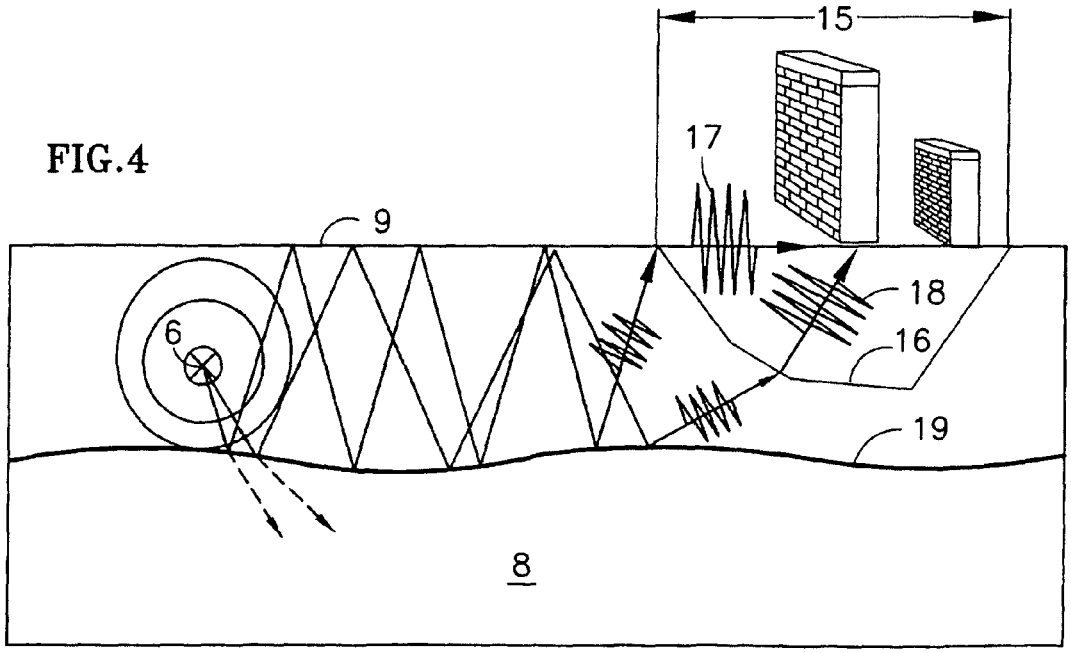
FIG. 4 is a diagram illustrating the propagation of a long-period seismic wave.

FIG. 4 is a diagram illustrating the state of propagation of the long-period seismic wave. As shown, when the earthquake is a lateral wave from the epicenter 6, it propagates at a speed of about 1000 m/h in hard rock as it is repeatedly reflected in an accumulation layer 16 of the earth's crust 19 between the mantle 8 and the ground surface 9. Then, as the seismic wave enters an accumulating flat area 15, the speed rapidly falls to ½-⅐ of the original speed. According to the law of conservation of energy, the vibration intensity is inversely proportional to the speed and rises to be 2-7 times that of the original intensity. This amplification is related to loose soil.

The seismic wave is reflected repeatedly in the underground accumulation layer 16, so that waves of certain periods cancel each other out and become weaker, while the waves at certain periods are amplified (labeled 18) due to constructive interference. As a result, in flat areas 15, the vibration occurs as a surface wave 17.

The period of the amplified surface wave 17 depends on the thickness and softness of the accumulation layer 16. For example, in the twenty-three districts of Tokyo with an accumulation layer thickness of about 2500 m, amplification is facilitated for 5-12 sec, while in Osaka and Nagoya, where the accumulation layer is about 1000 m, amplification is facilitated for 3-5 sec.

Figure 5:
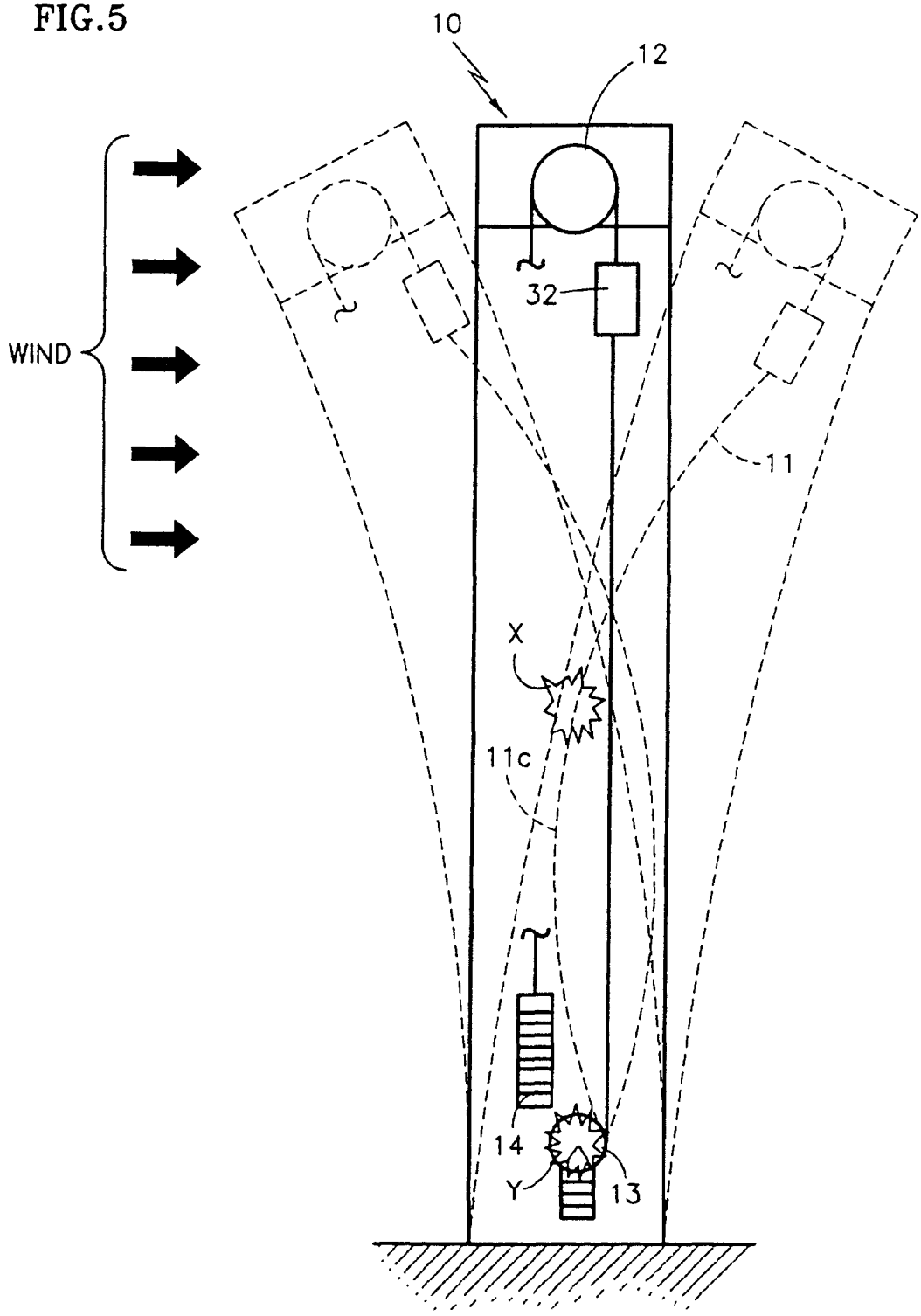
FIG. 5 is a schematic diagram illustrating building sway of a skyscraper.

FIG. 5 is a diagram illustrating the rocking of a skyscraper 10 (i.e., a building), at a low frequency due to a long-period earthquake or high winds. Provided in the skyscraper 10 are: a compensation rope 11*c;* a sheave 12; a compensation sheave 13; a counterweight 14; and a car 32. As the skyscraper 10 rocks at a low frequency (i.e., long-period vibration), a resonance phenomenon may occur as the rocking frequency of the skyscraper 10 and the intrinsic vibration frequency 11 of rope 11*c* are in agreement with each other. As result of such resonance, the compensation rope 11*c* may hit the wall of the elevator shaft (as indicated by X in the Figure), and/or the rope 11*c* may slip out of the compensation sheave 13 (as indicated by Y in the Figure).

The rocking characteristics of the skyscraper 10 shown in FIG. 5 are analyzed under the conditions listed in Table 1. Also, the analysis is performed for mode 1 (frequency 0.140 Hz) and mode 2 (frequency 0.171 Hz) both with a large amplitude as the bending modes; the result of these analyses are shown in FIG. 6.

TABLE 1

| | | |
|---|---|---|
| Load | 1156 | Kg |
| Speed) | 7 | m/s |
| Rise height | 278.53 | m |
| Weight of compensation rope | 0.937 | Kg/m |
| Diameter of compensation rope | 18 | mm |
| Weight of compensation sheave | 532 | Kg |
| Weight of main rope | 1.11 | Kg/m |
| Diameter of main rope | 18 | mm |
| Weight of governor rope | 0.536 | Kg/m |
| Tension of governor | 434 | Kg |
| Weight of traveling cable | 4.5 | Kg/m |
| Total weight of car | 3261 | Kg |
| Height of car | 3.8 | m |

Figure 6:
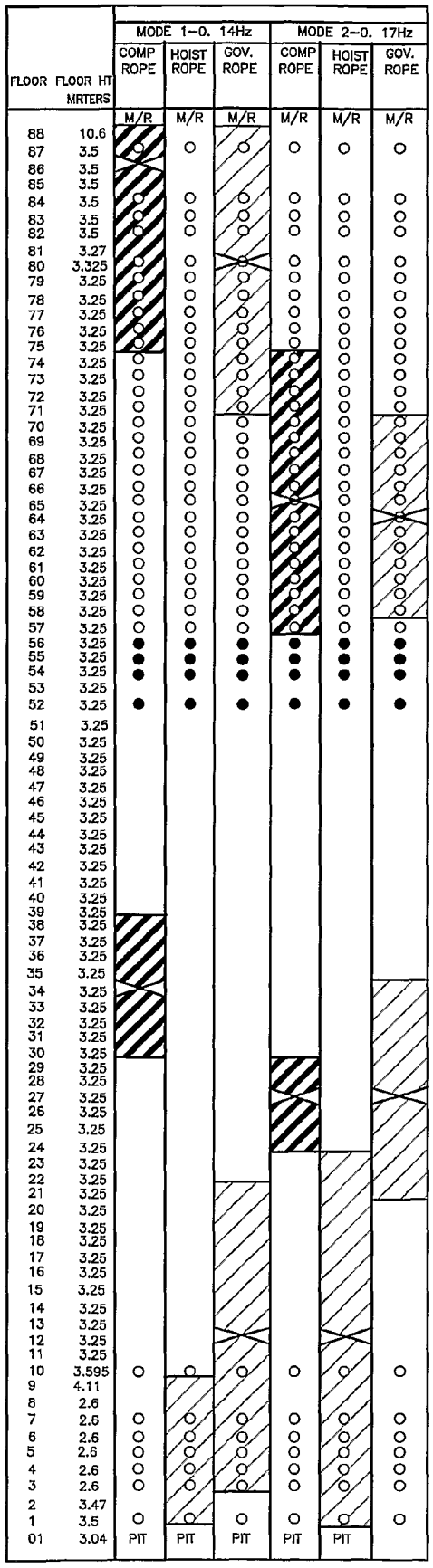
FIG. 6 is a diagram illustrating the results of analysis of the resonance of a building and of a rope caused by long-period vibrations.

In FIG. 6, the circles (solid and non-solid) indicate service floors, the solid circles (i.e., dots) indicate safe floors, the thick solid hatched lines indicate floors at which the compensation rope resonates (±10%), the broken hatched lines indicate floors at which the main rope resonates (±10%), the fine solid hatched lines indicate floors at which the governor rope resonates (±10%), and the X marks indicate locations at which the intrinsic vibration frequency of the particular rope is exactly matched to the intrinsic vibration of the building. According to the results of analysis shown in FIG. 6, the dangerous floors include floors 1-7, 10, and 57-88 and the safe floors include 52 and 54-56.

Figure 7B:
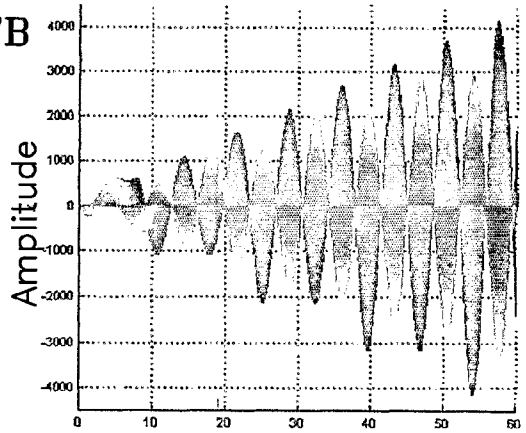
Figure 7C:
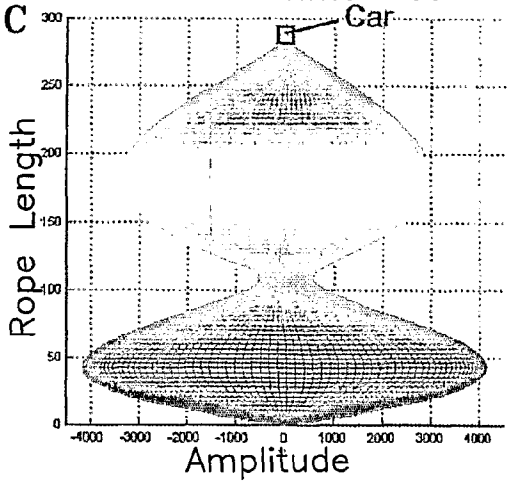
Figure 7A:
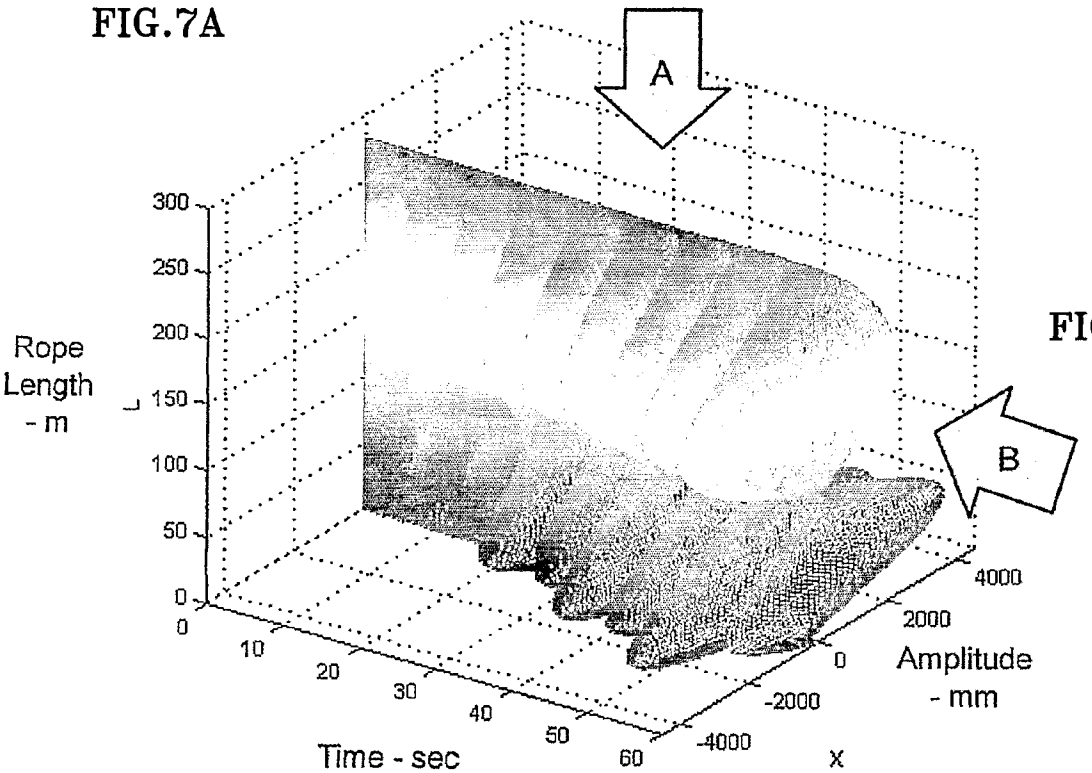
Figure 8B:
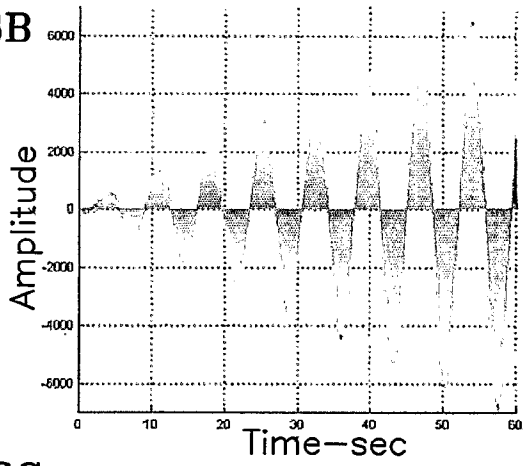
Figure 8C:
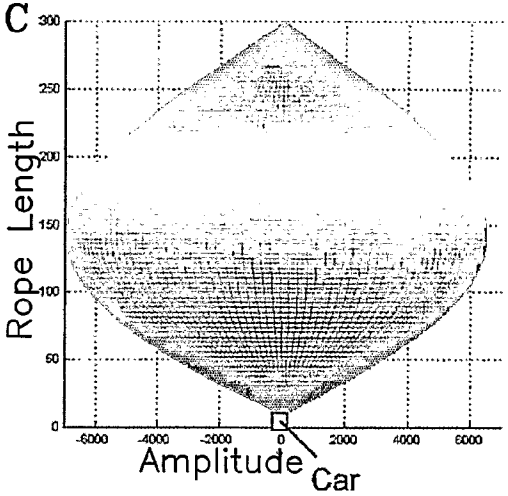
Figure 8A:
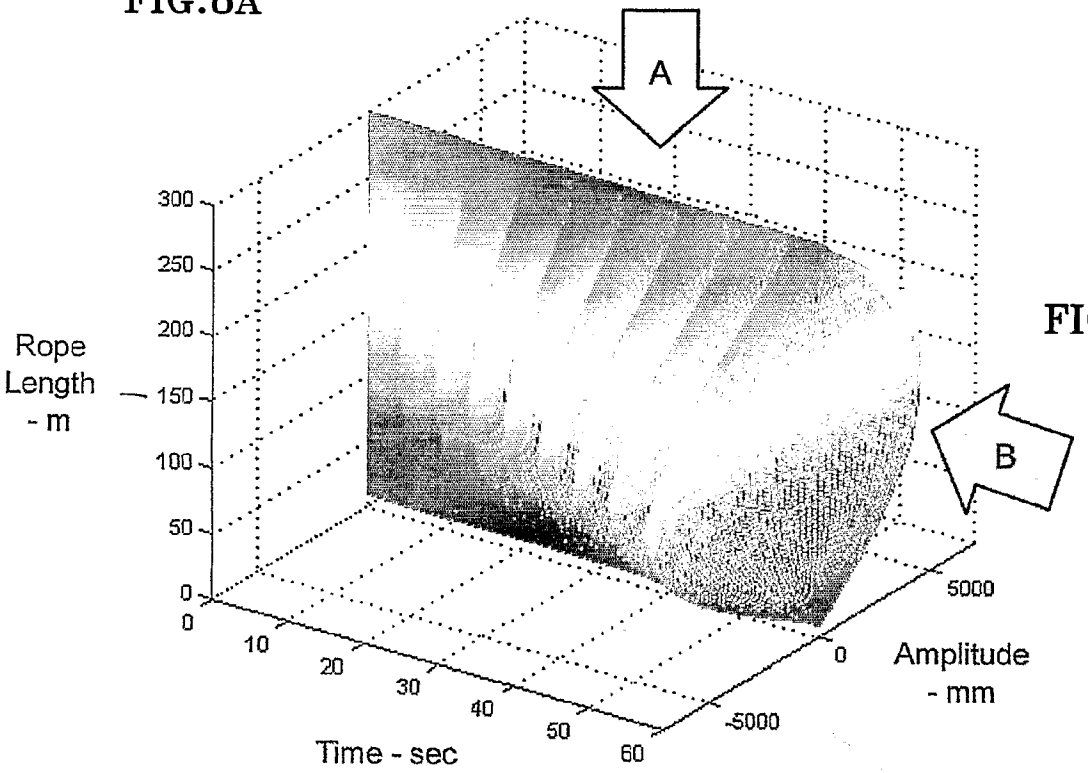

FIGS. 7A-7C and 8A-8C show the resultant characteristic of a behavioral prediction of the compensating and main ropes, respectively, when stopped on a dangerous floor under high winds. FIGS. 7A and 8A show the 3-axis characteristics of rope length versus time versus amplitude; FIGS. 7B and 8B show the characteristics as viewed from the direction indicated by arrow A in FIGS. 7A and 8A, respectively (i.e., the 2-axis characteristics of amplitude versus time); and FIGS. 7C and 8C show the characteristics as viewed in the direction indicated by arrow B of FIGS. 7A and 8A, respectively (i.e., the 2-axis characteristics of the rope length versus amplitude). FIGS. 7A-7C shows the characteristics of the compensation rope when the car 32 stops on the $87^{th}$ floor, which in this example is a dangerous floor (i.e., a compensation rope resonance floor) as shown in FIG. 6. FIGS. 8A-8C show the characteristics of the main rope when the car 32 stops on the $1^{st}$ floor, which in this example is also a dangerous floor (i.e., a main rope resonance floor) as shown in FIG. 6. As shown in FIGS. 7A-7C and 8A-8C, when the car 32 is on a dangerous floor, it is predicted that the rope amplitude will increase over time, which represents a dangerous state.

Figure 9B:
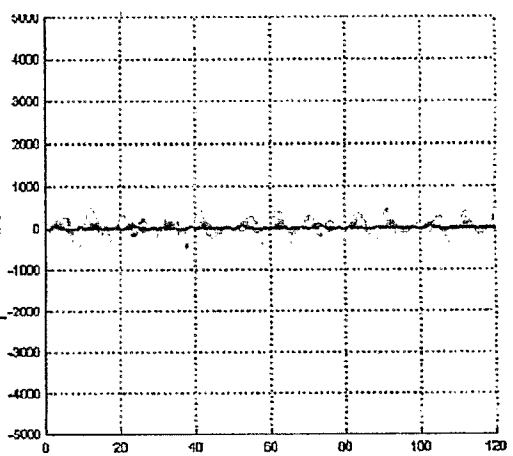
Figure 9C:
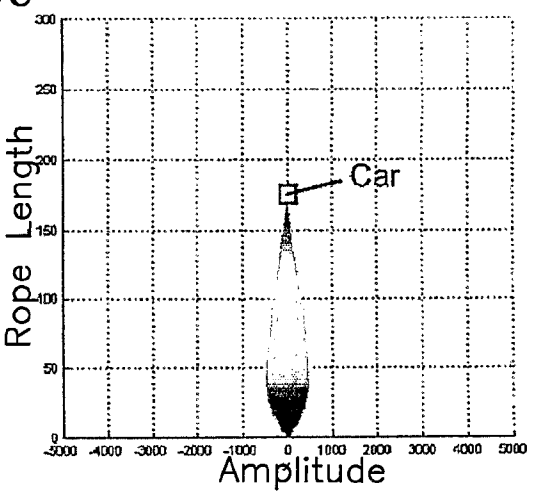
Figure 9A:
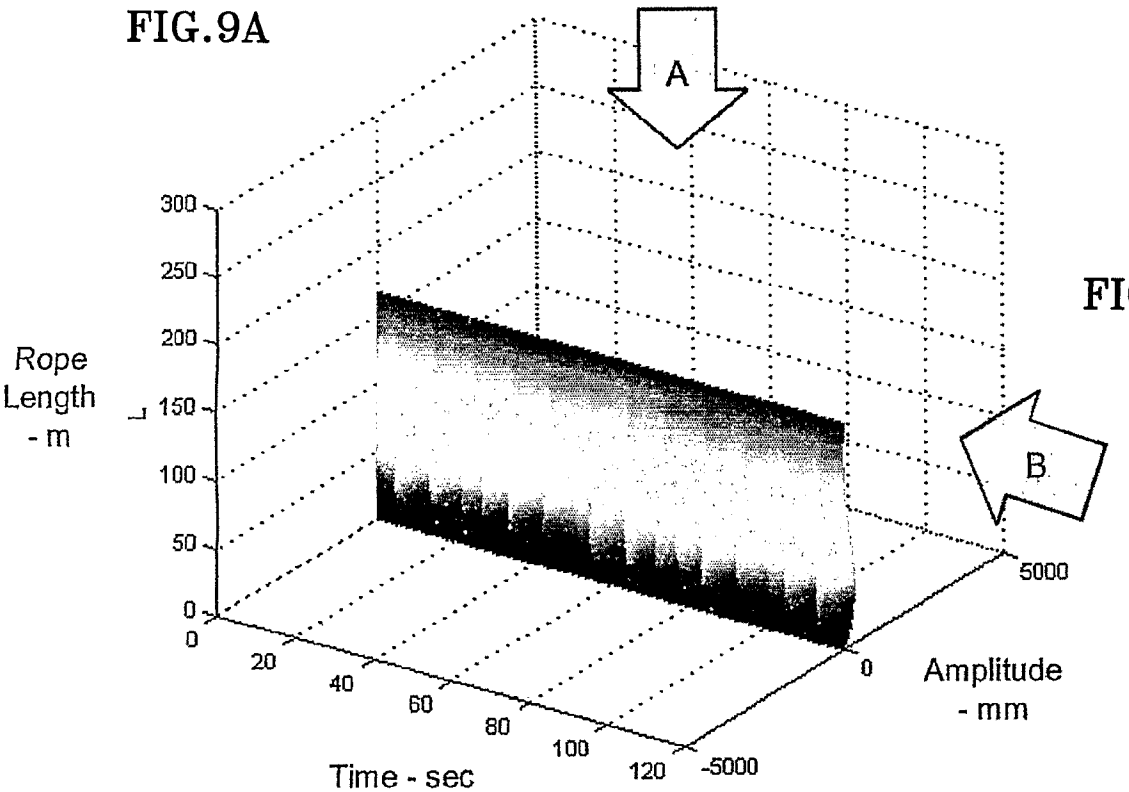
Figure 10B:
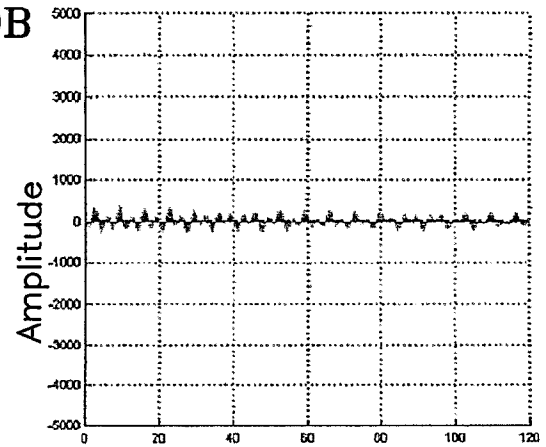
Figure 10C:
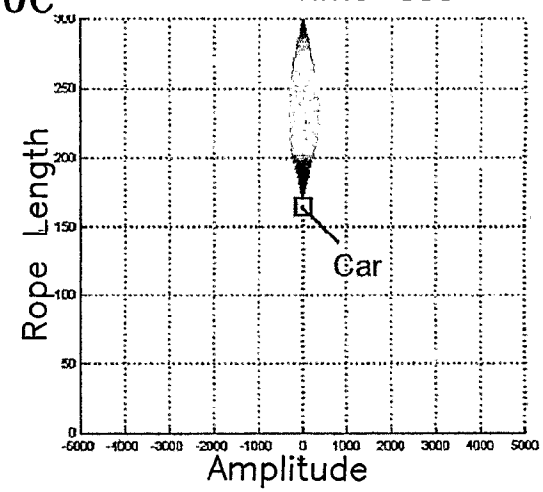
Figure 10A:
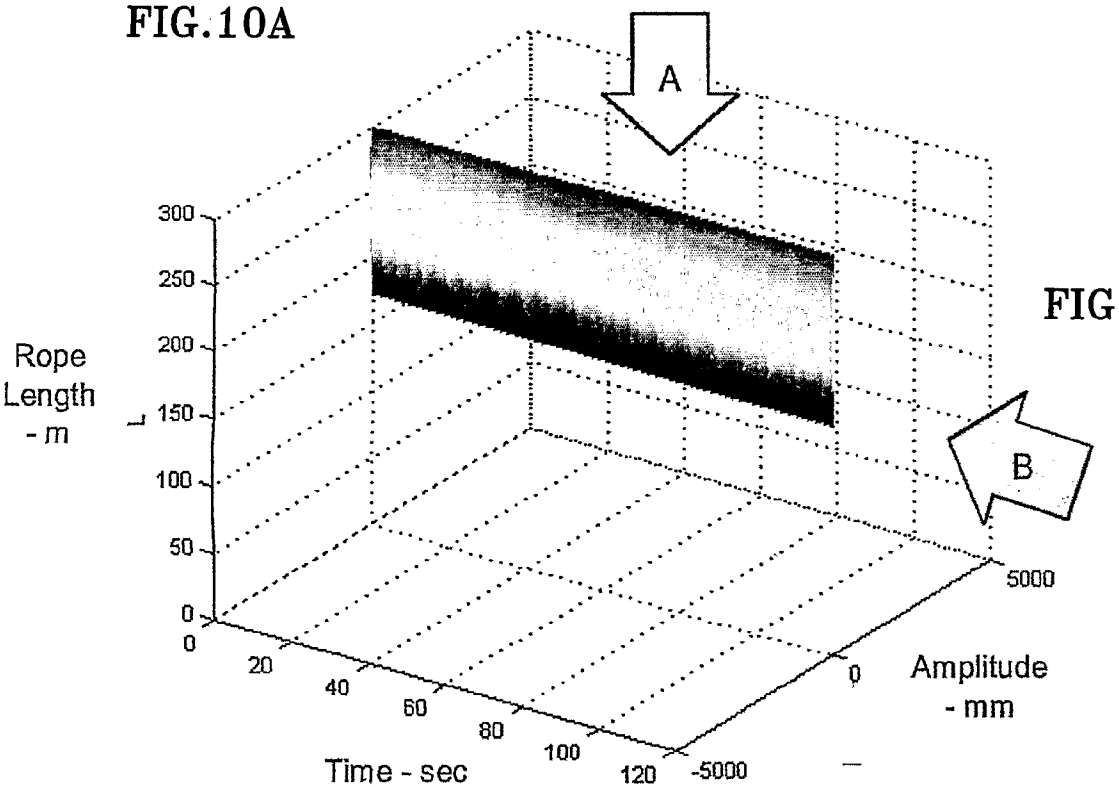

FIGS. 9A-9C and 10A-10C show the resultant characteristics of a behavioral prediction of the compensating and main ropes when stopped on a safe floor under high winds. FIGS. 9A and 10A show the 3-axis characteristics of rope length versus time versus amplitude; FIGS. 9B and 10B show the characteristics as viewed from the direction indicated by arrow A in FIGS. 9A and 10A, respectively (i.e., the 2-axis characteristics of amplitude versus time); and FIGS. 9C and 10C show the characteristics as viewed in the direction indicated by arrow B of FIGS. 9A and 10A, respectively (i.e., the 2-axis characteristics of the rope length versus amplitude). FIGS. 9A-9C and 10A-10C show the characteristics of the compensation rope and the main rope, respectively, when the car 32 stops on the $52^{nd}$ floor, which in this example is a safe floor, as shown in FIG. 6. According to FIGS. 9A-9C and 10A-10C, it is predicted that the ropes have no resonance, and there is no amplification of the amplitude over time.

An explanation will now be given regarding the behavior of the compensation rope during operation of the car. FIGS. 11A-11D and 12A-12D show the resultant characteristics of a behavioral prediction of the rope due to a change in the speed of the car 32 when the car 32 moves from the $88^{th}$ floor (i.e., a dangerous floor) to the $1^{st}$ floor (i.e., another dangerous floor) while rocking at a low frequency (0.140 Hz, period of 7.14286 sec).

Figure 12A:
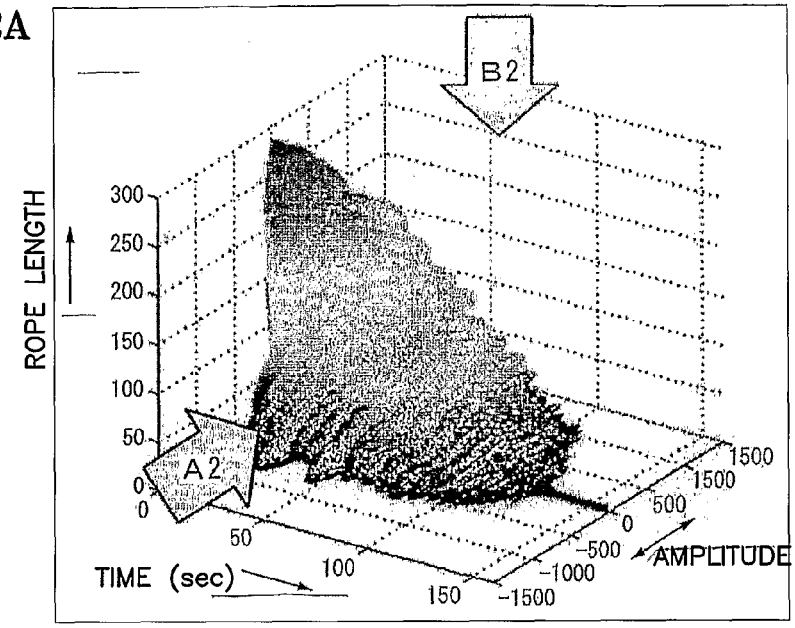
Figure 12B:
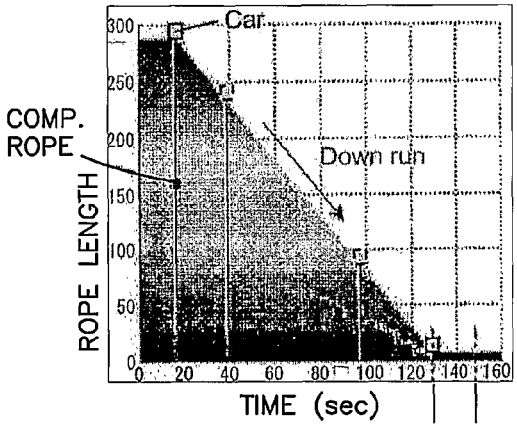
Figure 12C:
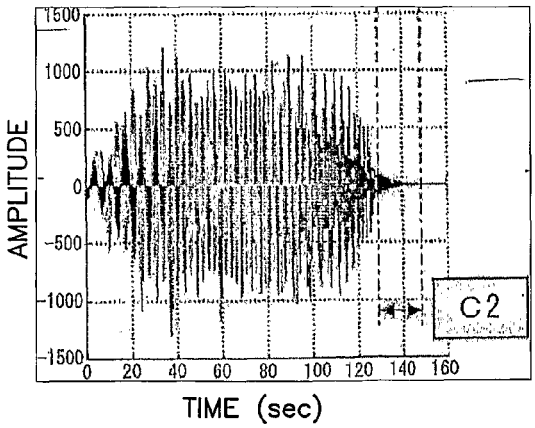
Figure 12D:
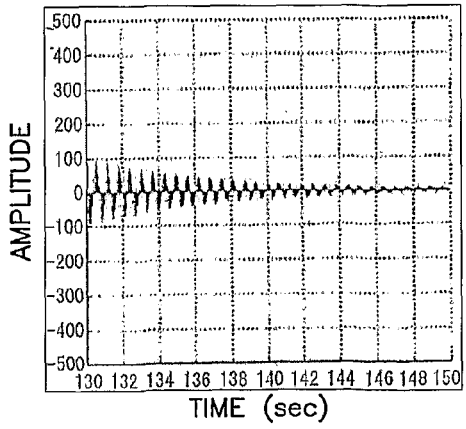

FIGS. 11A and 12A show the 3-axis characteristics of rope length versus time versus amplitude; FIGS. 11B and 12B show the characteristics as viewed from the direction indicated by arrows A1 and A2 in FIGS. 11A and 12A, respectively, (i.e., the 2-axis characteristics of rope length versus time); FIGS. 11C and 12C show the characteristics as viewed in the direction indicated by arrows B1 and B2 of FIGS. 11A and 12A, respectively (i.e., the 2-axis characteristics of the amplitude versus time); and FIGS. 11D and 12D show enlarged views of the 2-axis characteristics of amplitude versus time during time periods c1 and c2 in FIGS. 11C and 12C, respectively. FIGS. 11A-11D show the characteristics when the car moves at a speed of 5 m/s. FIGS. 12A-12D show the characteristics when the car moves at a speed of 2.5 m/s (i.e., 2.5 m/s slower than that shown in FIGS. 11A-11D).

In FIGS. 11A-11D, it can be seen that when the car 32 reaches the $1^{st}$ floor after 75 sec, the compensation rope vibrates wildly at a high frequency. Consequently, the compensation rope may slip out of the compensation sheave. In contrast, in FIGS. 12A-12D, it can be seen that when the car 32 arrives at the $1^{st}$ floor after 130 sec, the vibration of the compensation rope is reduced. Consequently, it can be predicted that by reducing the movement speed of the car 32, it is possible to reduce the vibration of the compensation rope when the car arrives at the $1^{st}$ floor. In comparing FIG. 11D to FIG. 12D, as the car approaches the $1^{st}$ floor, the rope length decreases, the speed decreases, and the amplitude (shown in FIG. 12C) becomes smaller. Consequently, it can be predicted that as the movement speed slows, even when the car moves, the amplitude of the compensation rope may be reduced.

As explained above with respect to FIG. 6, for each building, an analysis is performed to determine the safe floors at which the intrinsic vibration frequency of the elevator ropes are not in resonance with the intrinsic vibration frequency of the building during the long-period vibrations. The data from the results of the analysis are stored in the database 35 shown in FIG. 1. And, in step S4, which is shown in FIG. 2, the elevator car 32 can be moved to, and remain at (in standby mode), a safe floor indicated by the analysis result data.

As shown in FIGS. 12A-12D, during movement of the car 32 to the $1^{st}$ floor, the rope vibration was lowered based on the slower car speed; this car speed is determined analysis and is stored in the database 35. Accordingly, when the car is to be moved in steps S3 and S4 (FIG. 2), the car 32 may be driven to move at the stored speed.

Figure 13A:
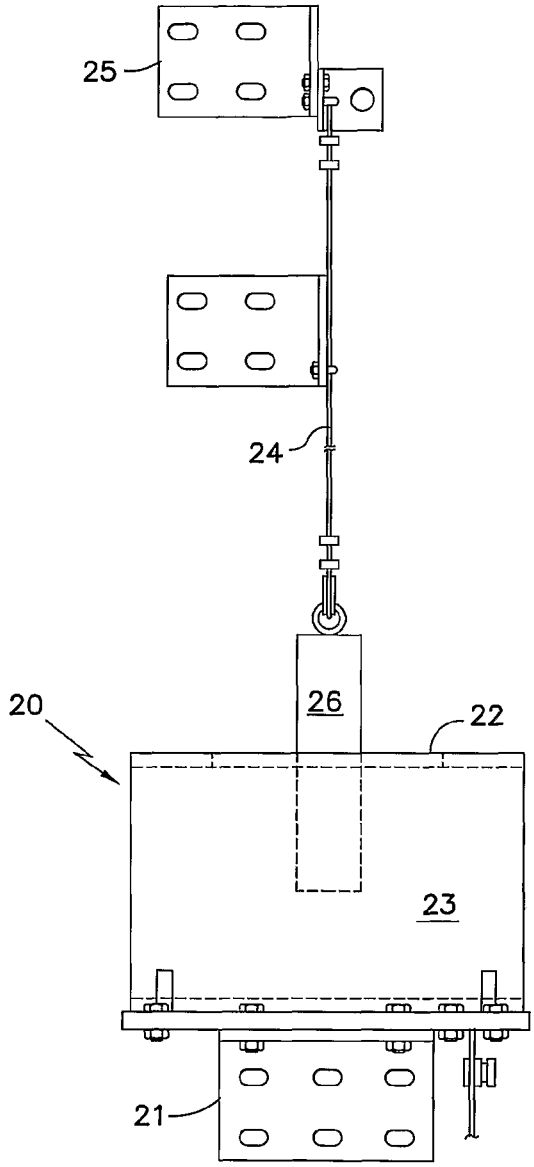
Figure 13B:
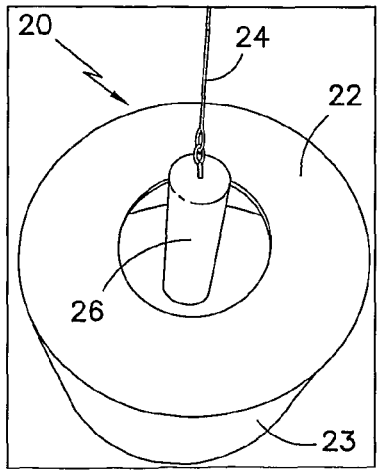

In the following, an explanation will be given regarding a specific example of a long-period vibration sensor interfaced with the sensor unit 5 shown in FIG. 1. In this embodiment, as the long-period vibration sensor, for example, a pendulum sensor 20 shown in FIG. 13 is used. The pendulum sensor 20 may be set in a machine room on the upper floor in the building 4 in which the elevator 3 is operating. The pendulum sensor 20 is composed of: (a) an upper insulator 25; (b) a wire 24, a first end of which, is connected to the upper insulator; (c) a flange; (d) a pendulum weight 26 that is suspended from a second end of the wire 24 and that is set in the inner peripheral space of the flange 22; (e) a cylinder 23 an upper end of which is connected to the flange 22; and (f) a lower insulator 21 that is connected to a lower end of the cylinder 23. The flange 22, the cylinder 23, and/or pendulum weight 26 may be formed of, for example, stainless steel (SUS304).

Figure 14:
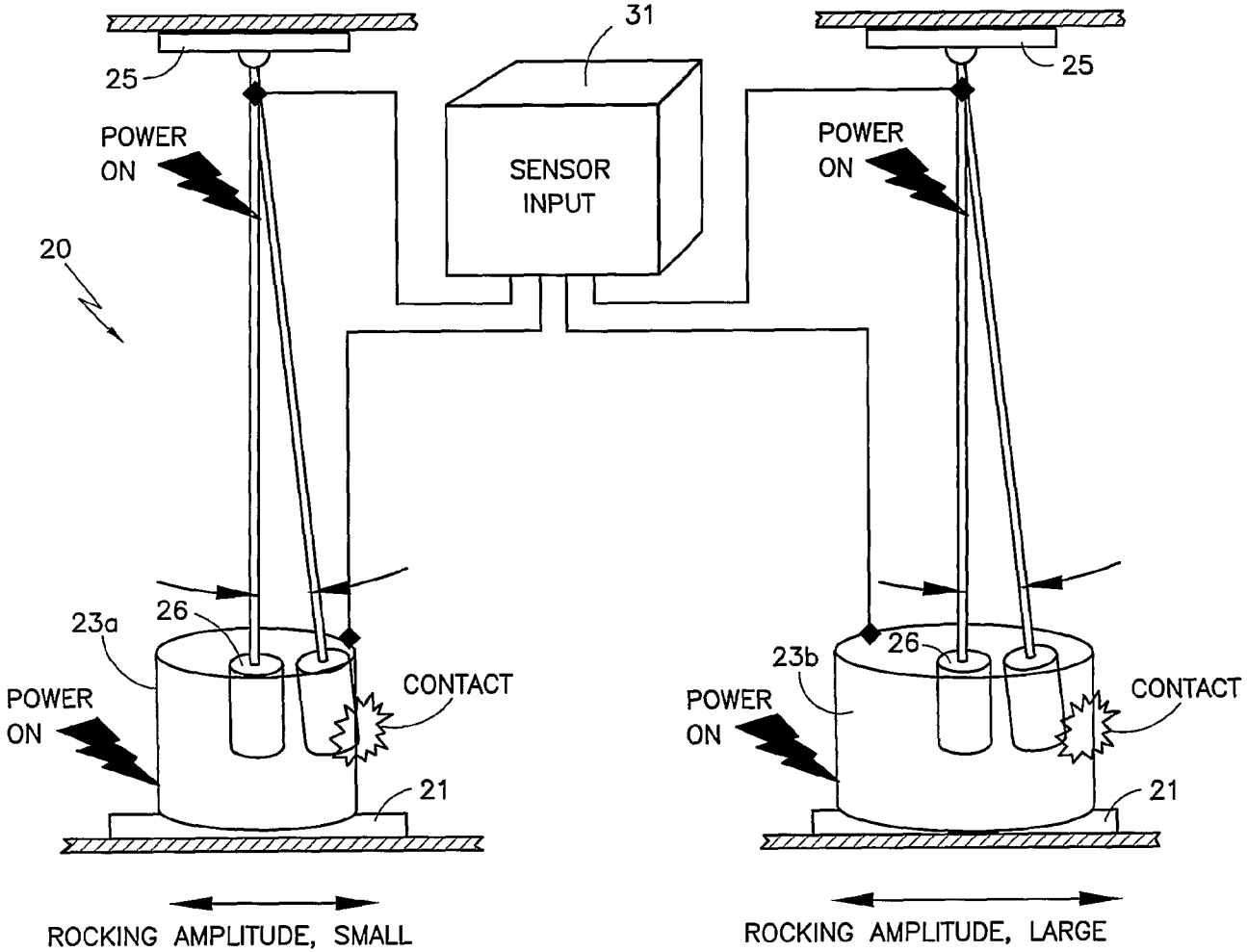
FIG. 14 is a diagram illustrating the operation of the pendulum sensor in an embodiment of the present invention.

As shown in FIG. 14, a prescribed voltage is applied between the portion on the side of the upper insulator 25, the wire 24, and the cylinder 23. As a result, when the weight 26 rocks and makes contact with the cylinder 23 (due to the long-period vibrations), current flows and the voltage drops. The drop in voltage is detected by the controller 31 of the elevator 3, so that the presence/absence of the long-period seismic waves can be detected.

The inner diameter 23*a* of the cylinder 23 is formed to detect long-period vibrations with small rocking amplitudes. In contrast, the outer diameter 23*b* of the cylinder 23 is formed relatively large and it is, therefore, used to detect long-period vibrations with large rocking amplitudes. Consequently, on the basis of the detection signal of the pendulum sensor 20, when the weight 26 does not make contact with cylinder 23, it is determined that the long-period vibration has been attenuated (step S21 of FIG. 3).

Figure 15:
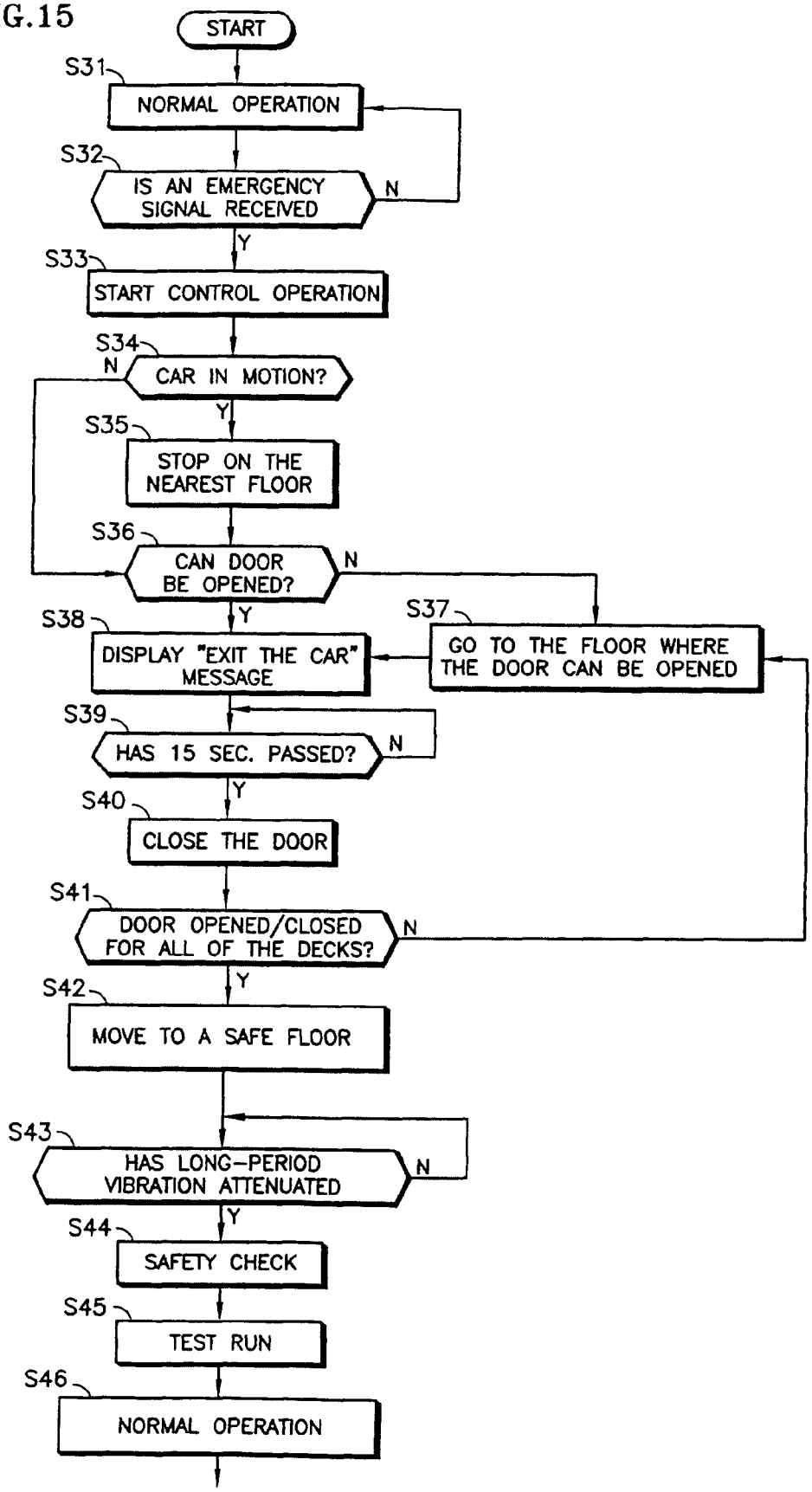
FIG. 15 is a flow chart illustrating an embodiment of a control process of the present invention.

FIG. 15 is a diagram illustrating the flow of more specific processing for the control performed by the controller 31 in FIGS. 2 and 3. First, in step S31 normal operations are performed. In step S32, it is determined whether an emergency earthquake signal has been received. If the result of step S32 is negative, control reverts back to step S31. If, however, the result of step S32 is positive, the earthquake control operation is started in step S33. For example, in step S33, the hall calls and car calls are invalidated, and the car display 33 and the landing display 34 display a message of, e.g., "EARTHQUAKE CONTROL OPERATION: WHEN THE DOORS OPEN, PLEASE GET OUT OF THE ELEVATOR" or the like. Similarly, the following audible announcement may be made: "POSSIBLE EARTHQUAKE DETECTED. WHEN THE DOORS OPEN, PLEASE GET OUT OF THE ELEVATOR." Also, a flasher and/or a buzzer may be activated.

Then, in step S34, it is determined whether the car is in motion. If the result of step S34 is negative, control proceeds to step S36, which later be discussed. If, however, the result of step S34 is positive, control proceeds to step S35, which stops the car on the nearest floor and then enables control to proceed to step S36. In step S36, it is determined whether the doors can be opened and, if so, the doors are opened and control proceeds to step S38. If the result of step S36 is negative (i.e., the doors can not be opened on the floor at which the car is stopped), control proceeds to step S37 in which the car is moved to a nearest floor at which the doors can be opened, the doors are then opened, and control then proceeds to step S38. In step S38, the car display 33 displays a message such as: "WHEN THE DOORS ARE OPEN, PLEASE EXIT THE ELEVATOR CAR."

In step S39, it is determined whether a certain period of time (e.g., 15 seconds) has passed since the doors were opened; this is the time needed for the passengers to leave the car to the floor at which the car stopped so that the passengers can seek safety. If the result of step S39 is negative, control reverts back to step S39 (i.e., to keep counting the time the doors have been open). If, however, the result of step S39 is positive (i.e., the time period has passed), control proceeds to step S40 at which the doors are closed and the display in the car is deactivated.

Then, in step S41, after the doors are closed in step S40, it is determined whether the doors of all of the decks of the car 32 have been opened and closed. If the result of step S41 is negative, control reverts to step S37 and the process is repeated through step S41 for each deck that did not have its doors opened and closed. If the result of step S41 is positive, control proceeds to step S42. It should be noted that step S11 is only necessary for elevator cars that have more than one deck. If the car has only one deck, control can proceed directly from step S40 to step S42.

In step S42, the elevator car runs at a predetermined (by the analysis the results of which are stored in database 35) speed to the safe floor indicated by the database 35 or to a floor that indicates data that allow safe running. Control then proceeds to step S43 in which, on the basis of the detection signal of sensor unit 5 (e.g., such as that of pendulum sensor 20 described in FIGS. 13 and 14), it is determined whether the long-period seismic waves have been sufficiently attenuated. If the result of step S43 is negative, control reverts back to step S43 (i.e., to keep waiting for the seismic waves to be attenuated). If, however, the result of step S43 is positive, control proceeds to step S44 at which a safety check is performed in which, for example, the presence of abnormalities in the elevator equipment are detected. If the result of the safety check in step S44 is negative, control proceeds to step S47. In step S47, the elevator car 32 is indefinitely stopped for inspection by a technician. If, however, the result of the safety check in step S44 is positive, control proceeds to step S45 in which a test run is executed.

During the test run, for example, the car 32 may initially descend at a slow speed, and then move up from the bottom floor to the top floor at a slow speed. If the result of the test run in step S45 is negative, control proceeds to step S47. If, however, the result of the test run in step S45 is positive, then control proceeds to step S46 in which full, normal operation of the car 32 is restored and the process ends. When the automatic restoration occurs, the car display 33 indicates normal operation. In addition, an audible announcement may be made. Further, the landing site display 34 may indicate the servable floors at which the elevator car 32 may stop.

This application claims priority to, and hereby incorporates by reference in its entirety, Japanese Priority Application No. JP2005-350145, which was filed on Dec. 5, 2005.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow. For example, although the full, normal operation of the car 32 was described in step S46 as being automatically restored, the operation of the car 32 may be manually restored.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

What is claimed is:

1. An earthquake control operating system for an elevator car provided in a hoistway of a building, the system comprising:

a receiver that is configured to receive emergency earthquake information;

a database that stores data pertaining to movement of the elevator car in the hoistway to a zone that is substantially unaffected by the influence of long-period vibrations; and a controller interfaced with the receiver and the database, wherein the controller is configured to move the elevator car to a zone that is substantially unaffected by the influence of the long-period vibrations on the basis of the data stored in the database when the emergency earthquake information is received by the receiver.

2. The system according to claim 1, wherein the controller is configured to determine whether there are any passengers in the elevator car when the emergency earthquake information is received by the receiver.

3. The system according to claim 2, wherein the controller is further configured to move the car to a nearest floor at which the doors of the elevator can be opened, if it is determined that any passengers are in the elevator car.

4. The system according to claim 1, comprising:

a long-period vibration detector provided in the building in which the elevator car is provided, wherein the controller is configured to resume the operation of the elevator car after a predetermined attenuation of the long-period vibration on the basis of signals from the long-period vibration detector.

5. The system according to claim 1, wherein the database stores data of the intrinsic vibration frequency of one or more ropes of the elevator and one or more zones in which there is no resonance of the one or more ropes with the intrinsic vibration frequency of the building, and wherein the controller is configured to move the elevator car to one of the zones free of resonance.

6. The system according to claim 5, wherein the database stores data of a speed at which the one or more ropes of the elevator have their intrinsic vibration frequency in a safety range in the case of long-period vibrations, and wherein the controller is configured to move the elevator car at the speed.

7. An earthquake control operating method for an elevator operating in a building, the method comprising the steps of:

determining one or more zones in the building that are substantially unaffected by the influence of long-period vibrations;

storing the zones that are substantially unaffected by the influence of long-period vibrations in database;

receiving emergency earthquake information;

obtaining, from the database, the one or more zones that are substantially unaffected by the influence of long-period vibrations; and moving a car of the elevator to one of the one or more zones that are substantially unaffected by the influence of long-period vibrations.

8. The method according to claim 7, further comprising the step of:

determining whether one or more passengers are in the car, when the emergency earthquake information is received.

9. The method according to claim 8, wherein, if it is determined that one or more passengers are in the car when the emergency earthquake information is received, the method further comprises the step of:

moving the car to a nearest floor; and opening doors of the car so as to enable the one or more passengers to exit the car.

10. The method according to claim 7, further comprising the step of:

maintaining the car in a non-operative state in the zone that is substantially unaffected by the influence of long-period vibrations until it is determined that the long-term period vibrations are attenuated to a predetermined degree.

11. The method according to claim 10, further comprising the step of:

enabling the car to return to an operative state, when it determined that the long-term period vibrations are attenuated to the predetermined degree.

12. The method according to claim 7, wherein the step of determining one or more zones in the building that are substantially unaffected by the influence of long-period vibrations comprises the step of:

ascertaining an intrinsic vibration frequency of one or more ropes that are connected to the car;

ascertaining an intrinsic vibration frequency of the building; and identifying one or more zones in the building in which the intrinsic vibration of the one or more ropes and the intrinsic vibration of the building are not in resonance.

13. The method according to claim 12, wherein the one or more zones in which the intrinsic vibration frequency of the one or more ropes and the intrinsic vibration frequency of the building are not in resonance define the one or more zones in the building that are substantially unaffected by the influence of long-period vibrations.

14. The method according to claim 12, wherein the step of determining one or more zones in the building that are substantially unaffected by the influence of long-period vibrations further comprises the step of:

ascertaining a safety speed at which the one or more ropes that are connected to the car can move to create a vibration frequency that is within a range that does not resonantly interact with the intrinsic vibration frequency of the building.

15. The method of according to claim 14, wherein the step of moving the car of the elevator to one of the one or more zones that are substantially unaffected by the influence of long-period vibrations comprises the step of:

moving the car at the safety speed to one of the one or more zones that are substantially unaffected by the influence of long-period vibrations.

16. The method according to claim 14, wherein the one or more zones in which the intrinsic vibration frequency of the one or more ropes and the intrinsic vibration frequency of the building are not in resonance define the one or more zones in the building that are substantially unaffected by the influence of long-period vibrations.

* * * * *